US006585578B2

(12) United States Patent
Lin

(10) Patent No.: US 6,585,578 B2
(45) Date of Patent: Jul. 1, 2003

(54) GIRINDING WHEEL MACHINE BRACKET ADJUSTABLE IN ANGLE

(76) Inventor: Jung-Hua Lin, No. 48, Lane 493, Sec. 3, Chung Shan Rd., Tan Tsu Country, Taichung Hsien (TW)

( * ) Notice: Subject to any disclaimer, the term of this patent is extended or adjusted under 35 U.S.C. 154(b) by 0 days.

(21) Appl. No.: 09/887,176

(22) Filed: Jun. 25, 2001

(65) Prior Publication Data

US 2002/0197943 A1 Dec. 26, 2002

(51) Int. Cl.[7] ..... B24B 19/00

(52) U.S. Cl. ..... 451/438; 451/349; 451/420; 451/457; 451/460; 451/403; 451/405

(58) Field of Search ..... 451/349–358, 451/361, 403, 404, 405, 420, 438, 457, 455, 451, 460

(56) References Cited

U.S. PATENT DOCUMENTS 2,069,395 A * 2/1937 Tautz
3,461,618 A * 8/1969 Lill et al.
3,566,550 A * 3/1971 Piccinino
3,698,140 A * 10/1972 Steadman
4,744,178 A * 5/1988 Afshar
5,515,754 A * 5/1996 Elkins ..... 81/117.9
5,676,592 A * 10/1997 Borgatti ..... 451/454

* cited by examiner

*Primary Examiner*—Eileen P. Morgan
(74) *Attorney, Agent, or Firm*—Browdy and Neimark, P.L.L.C.

(57) ABSTRACT

A grinding wheel machine bracket comprises a fixations eat having a long through hole to receive a screw for fastening the fixation seat with a grinding wheel machine. The fixation seat has a pivoting seat with an axial hole, and a pointer located at the top thereof. A bracket seat is provided with a loading surface, a threaded hole, and an arcuate shoulder plate located over the threaded hole. A threaded rod is engaged with the threaded hole of the fixation seat via the axial hole. The bracket seat is changed in angle in relation to the fixation seat so as to adjust the angle of the loading surface of the bracket seat in relation to the grinding wheel of the grinding wheel machine. The bracket seat is fixed by the threaded rod at an angle so set.

6 Claims, 6 Drawing Sheets

GIRINDING WHEEL MACHINE BRACKET ADJUSTABLE IN ANGLE

FIELD OF THE INVENTION

The present invention relates generally to a grinding wheel machine, and more particularly to a grinding wheel machine bracket which is adjustable in angle.

BACKGROUND OF THE INVENTION

As shown in FIG. 1, a grinding wheel machine 100 of the prior art comprises a motor 110, a grinding wheel 120 mounted on the output shaft of the motor 110 and driven by the motor 110 to turn. A grinding wheel shield 130 serves to shield the grinding wheel 120. An eye protecting plate 140 is fastened with the grinding wheel shield 130 for protecting the eyes of a machine operator from the flying debris in the course of the grinding operation. A bracket 150 is provided at one end with a fastening portion 151 and a long through hole 152 for receiving two bolts 190 which are used to fix the bracket 150 on the grinding wheel shield 130. The fastening portion 151 is provided at the outer end with a support planar surface 153 corresponding to the peripheral edge of the grinding wheel 120. The support planar surface 153 has a long placing slot 154 for placing a workpiece (not shown in the drawing) such that the workpiece is secured in place at a grinding angle.

The planar support surface 153 of the bracket 150 and the grinding wheel 120 form therebetween a fixed angle, which allows the grinding wheel 120 to work on the workpiece at a specific grinding angle. In the general grinding operation, the grinding angle is set by the machine operator who must hold the workpiece. As a result, the workpiece is not supported by the bracket 150, thereby resulting in failure of the grinding operation.

The bracket 150 of the prior art may be fixed by only one bolt 190 which is put through the through hole 152 of the fastening portion 151. The bracket 150 is angularly adjusted by unfastening the bolt 190. The prior art structure is defective in design in that the bracket 150 is apt to sway due to the bolt 190 being separated from the planar surface 153 by a greater distance, thereby resulting in a greater moment of force exerting on the bolt 190. In addition, the machine operator is not sure of the degree of the angle that has been adjusted.

SUMMARY OF THE INVENTION

The primary objective of the present invention is to provide a grinding wheel machine with a means to adjust the angle between the bracket support surface and the grinding surface of the grinding wheel.

The present invention comprises a fixation seat which is fixed at a predetermined position of a grinding wheel machine. A bracket seat has a load surface. A connection member is used to pivot the bracket seat with the fixation seat, thereby enabling the angle between the bracket seat and the fixation seat to be adjusted. The bracket seat is thus fixed at a predetermined angle by adjusting the angle between the load surface of the bracket seat and the grinding wheel of the grinding wheel machine.

DETAILED DESCRIPTION OF THE INVENTION

Figure 1:
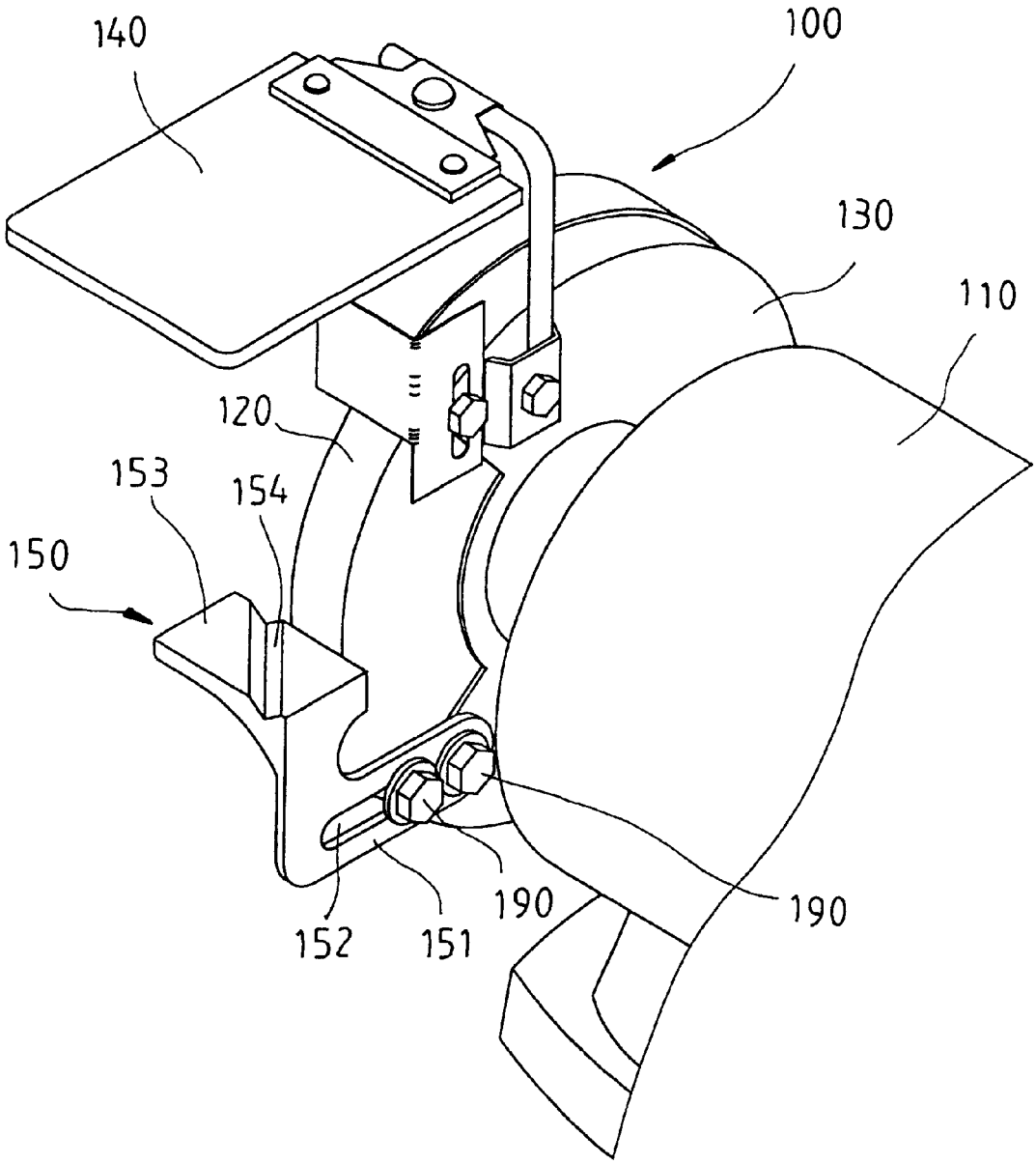
FIG. 1 PRIOR ART
FIG. 1 shows a perspective view of a grinding wheel machine of the prior art.
Figure 2:
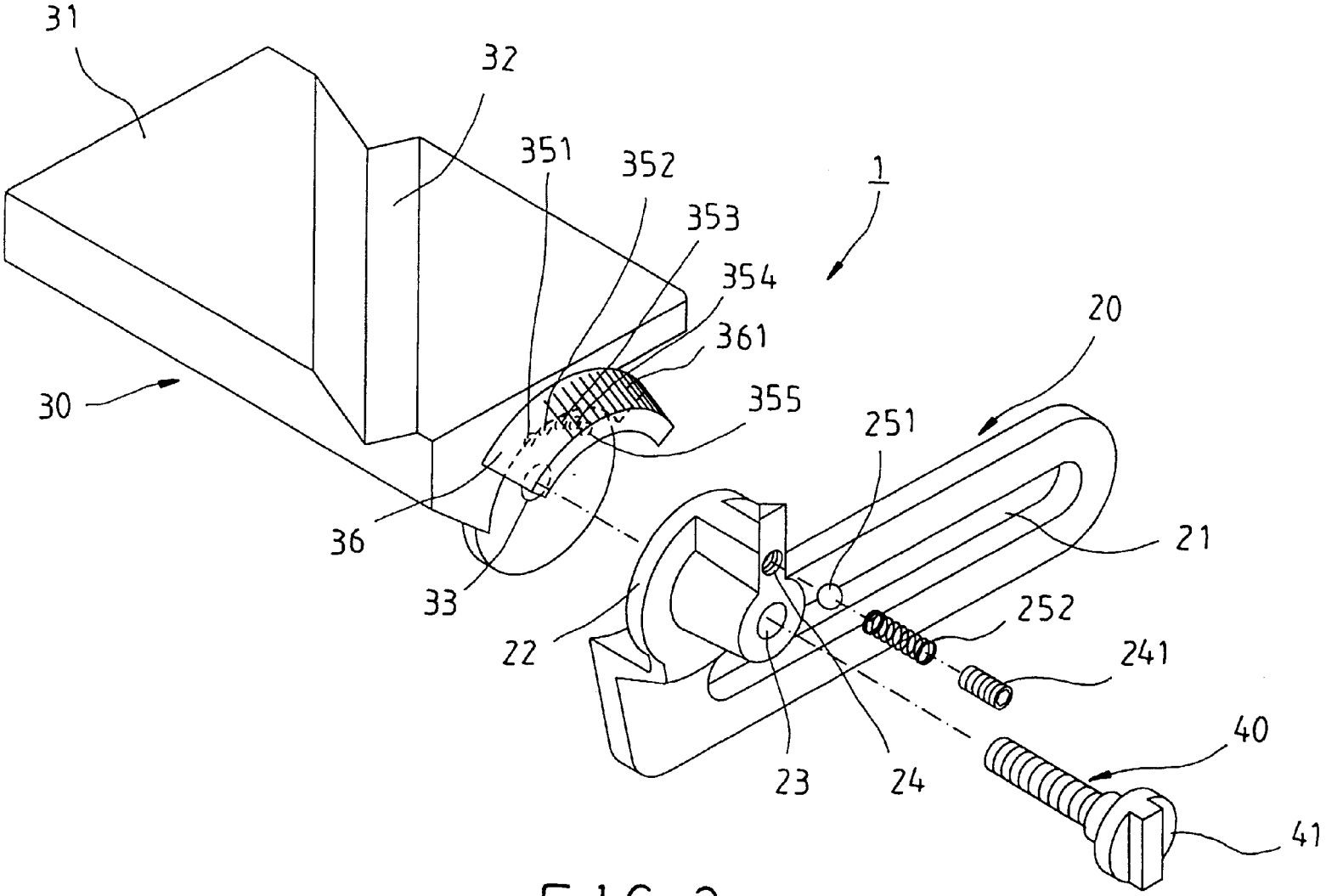
FIG. 2 shows an exploded view of a first preferred embodiment of the present invention.

As shown in FIG. 2, a grinding wheel machine bracket 1 embodied in the present invention comprises the following component parts.

Figure 3:
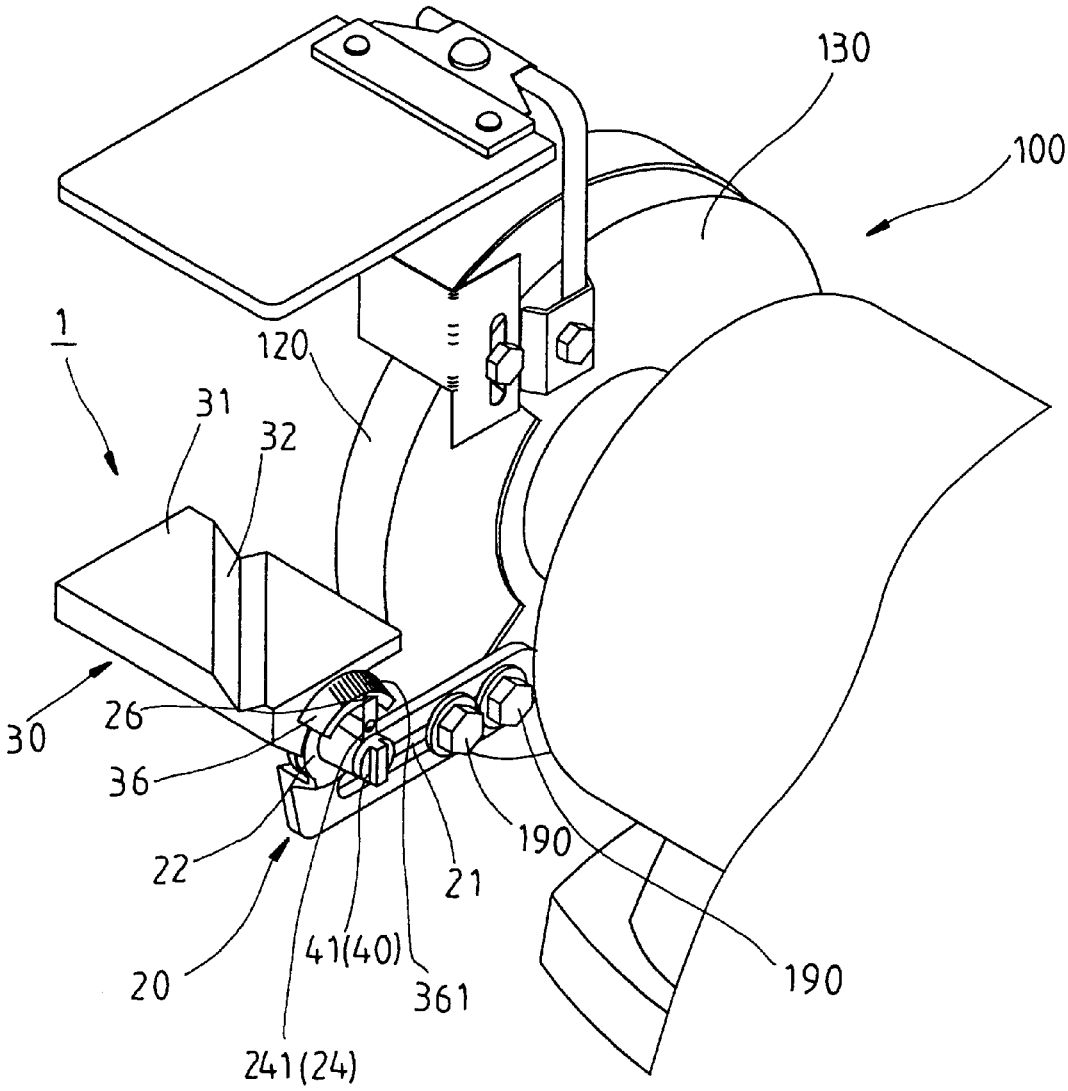
FIG. 3 shows a perspective view of the first preferred embodiment of the present invention mounted on a grinding wheel machine.

A fixation seat 20 is a long plate and is provided with a long through hole 21 to receive two bolts 190 by means of which the fixation seat 20 is fixed on the grinding wheel shield 130 of a grinding wheel machine 100, as shown in FIG. 3. The fixation seat 20 is provided in the top in proximity of the front end thereof with a pivoting seat 22 which is provided in the center with an axial hole 23, and a receiving hole 24 which is located over the axial hole 23 and is provided with a metal ball 251 and spring 253, and then a bolt 241 for sealing off the opening of the outer side of the receiving hole 24. The opening of the inner side of the receiving hole has a diameter slightly small than the metal ball 251, thereby enabling the metal ball 251 to be urged by the spring 252 in such a manner that a portion of the metal ball 251 is partially jutted out of the inner side opening of the receiving hole 24. The pivoting seat 22 is provided at the top with a pointer 26, which will be described further later.

A bracket seat 30 is a block body having in the top side thereof a support planar surface 31 which is provided with a long placing slot 32. The bracket seat is provided in one side with a threaded hole 33, and five round recessions 351–355 which are located over the threaded hole 33 serving as a circle center such that the round recessions are separated from one another at an interval of five degrees. The bracket seat is provided in one side with an arcuate shoulder plate 36 which is provided with an angle scale 361 with angle indicia corresponding to that set by the round recessions 351–355.

A connection member 40 of the preferred embodiment is a threaded rod, which is put through the axial hole 23 of the fixation seat 20 to be engaged with the threaded hole 33 of the bracket seat 30. The bracket seat 30 is pivoted with the fixation seat 20 such that the bracket seat 30 is adjusted in angle in relation to the fixation seat 20. The connection member 40 is provided at the outer end with a rotary button 41 for use in fastening or unfastening the connection member 40. The pointer 26 of the fixation seat 20 is corresponding to the angle scale 361 of the shoulder plate 36 of the bracket seat 30. Finally, the two bolts 190 are put through the through hole 21 for fastening the fixation seat 20 with a grinding wheel machine 100, as shown in FIG. 3.

In using the bracket of the first preferred embodiment of the present invention, the connection member 40 is slightly loosened to enable the bracket seat 30 to be turned such that the support planar surface 31 and the grinding wheel 110 of the grinding wheel machine 100 form a predetermined angle. The connection member 40 is subsequently fastened so as to fix the angle of the bracket seat 30. A workpiece can be now placed in the placing slot 32 of the planar surface 31 of the bracket seat 30, so as to proceed with the grinding operation.

According to the first preferred embodiment of the present invention, the angle of the planar surface 31 of the bracket seat 30 is made sure by the machine operator in such a way that the operator observes the pointer 26 which points at the scale 361 of the shoulder plate 36. Now referring to FIGS. 4 and 5, as the bracket seat 30 is turned an angle of 5 degrees in relation to the fixation seat 20, the metal ball 251 moves from one round recessions 352 to an adjoining round recessions 353, thereby enabling the bracket seat 30 to turn in a step-by-step manner. As a result, each time when the bracket seat 30 is turned an angle of 5 degrees, the bracket seat 30 is provided with a locating restriction force to bring about a sound by means of which the operator is sure of the angle that the bracket seat 30 is turned.

Figure 4:
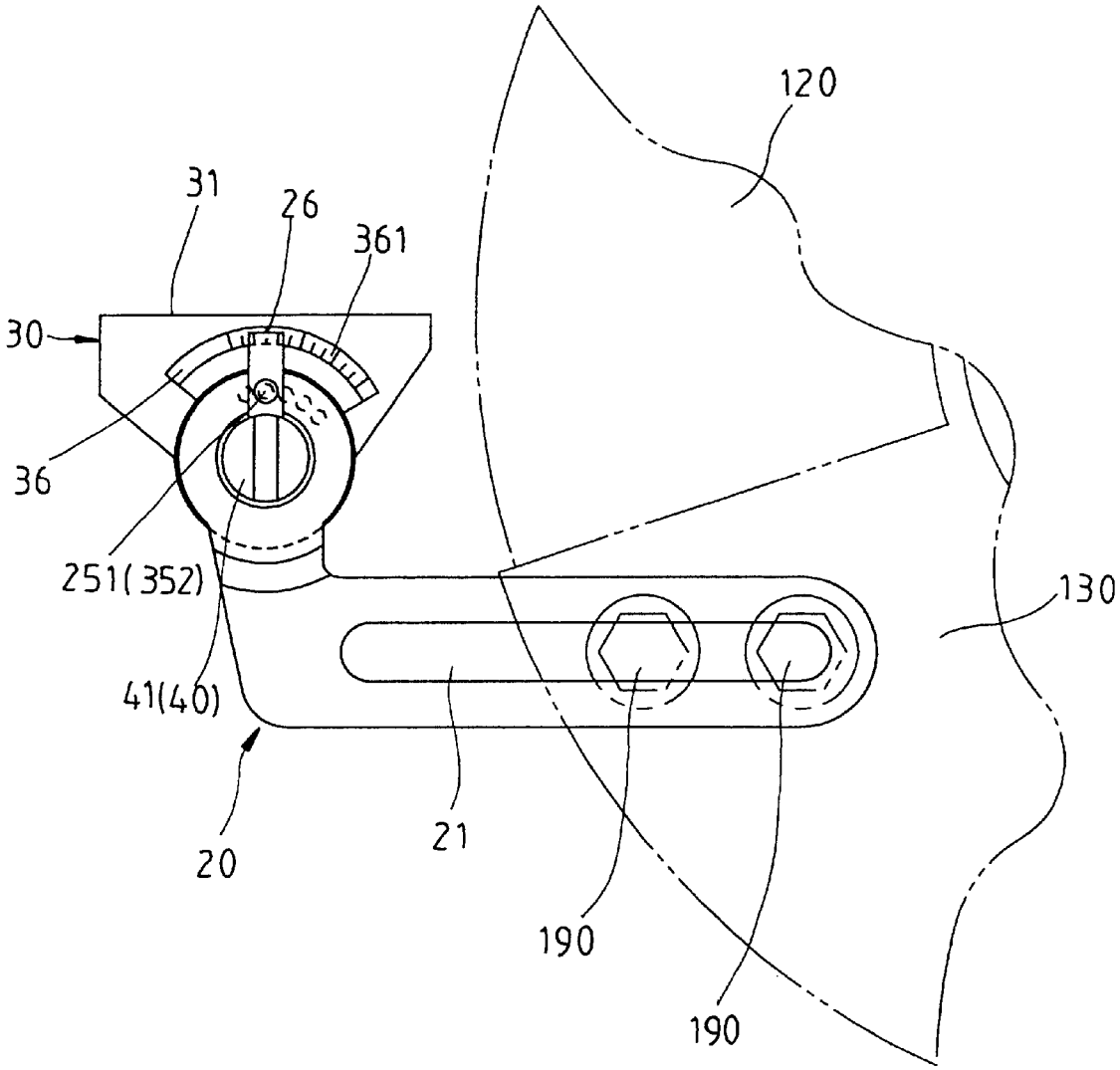
FIG. 4 shows a side view of the first preferred embodiment of the present invention.
Figure 5:
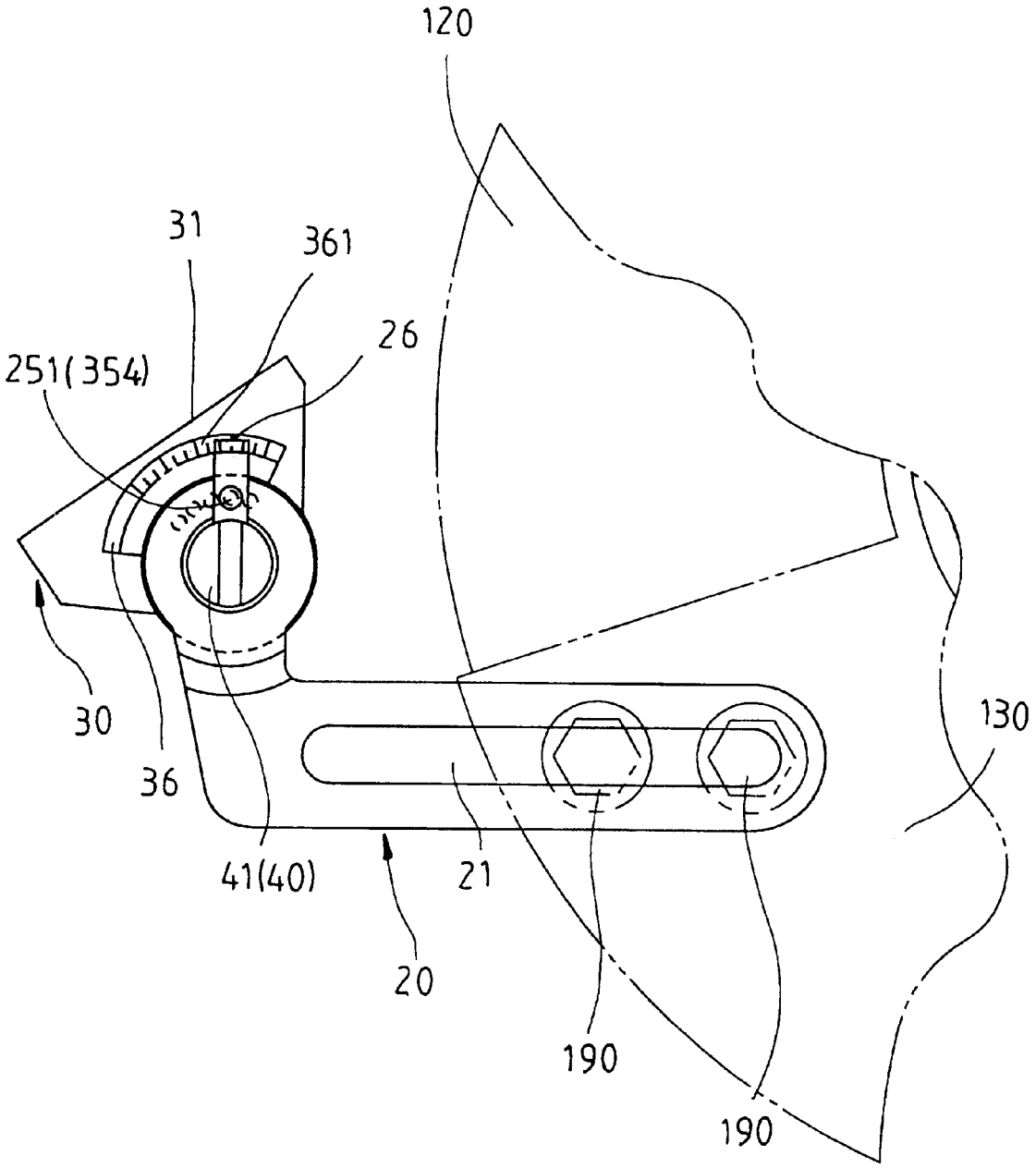
FIG. 5 is a continuation from FIG. 3 to show a schematic view of the angular adjustment of a load seat.

As shown in FIG. 4, the bracket seat 30 of the first preferred embodiment of the present invention is set such that the metal ball 251 is corresponding to the second round recessions 352 of the left side of the bracket seat 30, the planar surface 31 of the bracket seat 30 is perpendicular to the grinding wheel 110. The pointer 26 points at zero degree of the angle scale 361. The number of the round recessions is dependent on the need of the user. In addition, the round recessions may be separated from one another at any interval.

Figure 6:
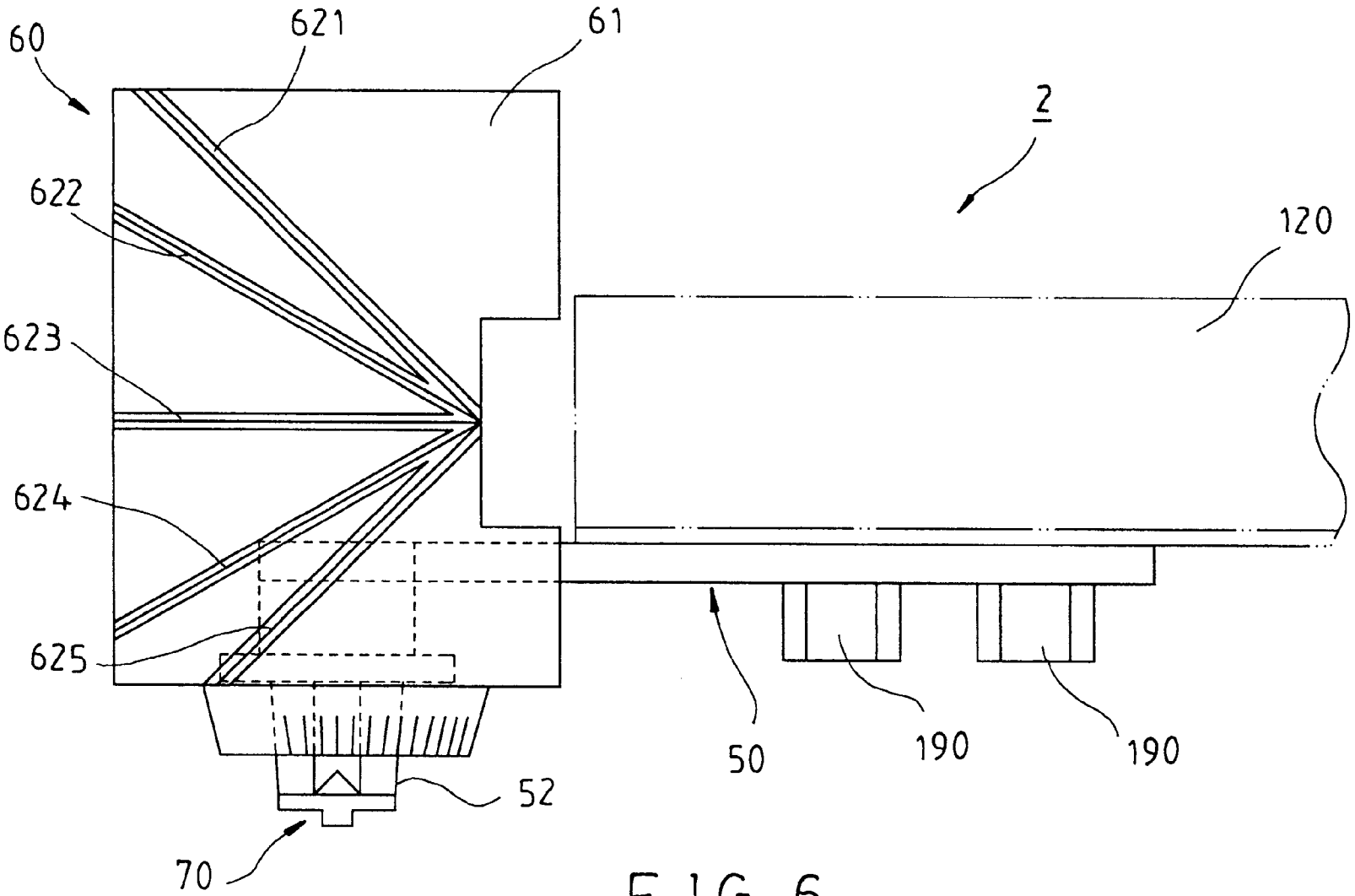
FIG. 6 shows a plan view of a second preferred embodiment of the present invention.

The first preferred embodiment of the present invention serves to provide the machine operator with a means to adjust the angle of elevation and the angle of depression of the planar surface 31 of the bracket seat 30. The lateral angle of the workpiece in relation to the grinding wheel 120 of the grinding wheel machine 100 is fixed by the extension angle of the placing slot 32 of the planar surface 31. The second preferred embodiment of the present invention provides a bracket 2 to facilitate the adjusting of the lateral angle of the workpiece in relation to the grinding wheel 120 of the grinding wheel machine 100. As shown in FIG. 6, the second preferred embodiment is mostly similar in construction to the first preferred embodiment and is formed of a fixation seat 50 having a pivoting seat 52, a bracket seat 60 having a planar surface 61, and a connection member 70 for pivoting the bracket seat 60 with the fixation seat 50. The second preferred embodiment is characterized by the planar surface 61 which is provided with five long placing slots 621–625 arranged in a radiate manner. The extension direction of the middle placing slot 623 is perpendicular to the grinding edge of the grinding wheel 120. The remaining slots 621, 622, 624, and 625 have angles of inclination of 30 degrees and 45 degrees in relation to the middle placing slot 623. The machine operator may choose the lateral angle of the workpiece in relation to the grinding wheel 120. The number and the angle of the placing slots are dependent on the need of the machine makers.

The present invention has advantage over the prior art structure in design in that the present invention enables a machine operator to adjust in accordance with the work requirement the angle of a workpiece in relation to the grinding wheel. The adjusting mechanism of the present invention is simple and competitive in terms of marketability.

What is claimed is:

1. A grinding wheel machine bracket comprising:

a fixation seat engaged to a grinding wheel machine, the fixation seat having a pivoting seat with an axial hole;

a bracket seat having a threaded hole and a loading surface for placing a workpiece;

the bracket seat being rotatably engaged to the pivoting seat by a threaded connection member extending through the axial hole and threaded in the threaded hole to permit adjustment to a selected angle of said loading surface in relation to a grinding wheel of the grinding wheel machine and to fasten the bracket seat to the pivoting seat at the selected angle;

a pointer on the fixation seat;

a shoulder plate on the bracket seat having an angle scale including indicia of selectable angles of the loading surface when aligned with the pointer, a receiving hole containing a metal ball and a spring biased against the metal ball in the fixation seat, and a plurality of round recesses in the bracket seat which receive the metal ball to produce a sound audible to a user when the angle scale is rotated to align with the pointer to select any one of the selectable angles of the loading surface.

2. The grinding wheel machine bracket defined in claim 1, wherein an interval between the selectable angles is five degrees.

3. The grinding wheel machine bracket as defined in claim 1, wherein said loading surface of said bracket seat is provided with at least one placing slot.

4. The grinding wheel machine bracket as defined in claim 3, wherein said loafing surface of said bracket seat is provided with a plurality of placing slots, each of the placing slots being formed at a specific angle in relation to the grinding wheel of the grinding wheel machine.

5. The grinding wheel machine bracket as defined in claim 1, wherein said fixation seat has a through hole for receiving at least one bolt for fastening said fixation seat to the grinding wheel machine.

6. The grinding wheel machine bracket defined in claim 1, wherein the threaded connection member has a button on an end thereof to facilitate turning the threaded connection member in the threaded hole.

* * * * *